US007261528B2

(12) United States Patent
Liepert et al.

(10) Patent No.: US 7,261,528 B2
(45) Date of Patent: Aug. 28, 2007

(54) SCROLL PUMP WITH LOAD BEARING SYNCHRONIZATION DEVICE

(75) Inventors: Anthony G. Liepert, Lincoln, MA (US); Sean E. Plaisted, Newburyport, MA (US)

(73) Assignee: Varian, Inc., Palo Alto, CA (US)

( * ) Notice: Subject to any disclaimer, the term of this patent is extended or adjusted under 35 U.S.C. 154(b) by 281 days.

(21) Appl. No.: 10/812,520

(22) Filed: Mar. 30, 2004

(65) Prior Publication Data

US 2005/0220647 A1 Oct. 6, 2005

(51) Int. Cl.
*F03C 2/00* (2006.01)
*F03C 4/00* (2006.01)

(52) U.S. Cl. ..... 418/55.3; 418/55.1; 464/102

(58) Field of Classification Search ..... 418/55.1–55.6, 418/57; 464/88, 102
See application file for complete search history.

(56) References Cited

U.S. PATENT DOCUMENTS 3,560,119 A * 2/1971 Busch et al. ..... 418/55.3
3,802,809 A * 4/1974 Vulliez ..... 418/55.3
4,371,323 A 2/1983 Fischer et al.
4,534,718 A 8/1985 Blain
5,616,015 A 4/1997 Liepert
5,951,268 A 9/1999 Pottier et al.
6,022,202 A * 2/2000 Pottier et al. ..... 418/55.3
6,764,288 B1 * 7/2004 Liepert et al. ..... 418/55.5

FOREIGN PATENT DOCUMENTS

EP 0 797 003 A1 9/1997
JP 02245488 A * 10/1990
JP 07 269476 A 10/1995
JP 11280675 A * 10/1999

* cited by examiner

*Primary Examiner*—Theresa Trieu
(74) *Attorney, Agent, or Firm*—Bella Fishman

(57) ABSTRACT

Scroll pumping apparatus includes a first scroll element and a second scroll element, a drive mechanism operatively coupled to the second scroll element for producing orbiting motion of the second scroll element relative to the first scroll element, and a synchronization device including a strip having connected, substantially flat sections, coupled between the first scroll element and the second scroll element. The synchronization device may have a generally square configuration.

20 Claims, 8 Drawing Sheets

SCROLL PUMP WITH LOAD BEARING SYNCHRONIZATION DEVICE

FIELD OF THE INVENTION

This invention relates to scroll-type pumps and, more particularly, to devices and methods for synchronization of orbiting and stationary scroll elements in scroll-type pumps.

BACKGROUND OF THE INVENTION

Scroll devices are well known in the field of vacuum pumps and compressors. In a scroll device, a movable spiral blade orbits with respect to a fixed spiral blade within a housing. The movable spiral blade is connected to an eccentric drive mechanism. The configuration of the scroll blades and their relative motion traps one or more volumes or "pockets" of a gas between the blades and moves the gas through the device. Most applications apply rotary power to pump the gas through the device. Oil-lubricated scroll devices are widely used as refrigerant compressors. Other applications include expanders, which operate in reverse from a compressor, and vacuum pumps. Scroll pumps have not been widely adopted for use as vacuum pumps, mainly because the cost of manufacturing a scroll pump is significantly higher than a comparably-sized, oil-lubricated vane pump. Dry scroll pumps have been used in applications where oil contamination is unacceptable. A high displacement rate scroll pump is described in U.S. Pat. No. 5,616,015, issued Apr. 1, 1997 to Liepert.

A scroll pump includes stationary and orbiting scroll elements, and a drive mechanism. The stationary and orbiting scroll elements each include a scroll plate and a spiral scroll blade extending from the scroll plate. The scroll blades are intermeshed together to define interblade pockets. The drive mechanism produces orbiting motion of the orbiting scroll element relative to the stationary scroll element so as to cause the interblade pockets to move toward the pump outlet.

Scroll pumps typically utilize one or more devices for synchronizing the intermeshed scroll blades. Each synchronizing device is coupled, directly or indirectly, between the stationary and orbiting scroll elements and is required to permit orbiting movement while preventing relative rotation of the scroll elements. In one prior art approach, three crank mechanisms are connected between the orbiting and stationary scroll elements.

U.S. Pat. No. 5,951,268, issued Sep. 14, 1999 to Pottier et al. discloses scroll pumps which utilize a metal bellows for synchronizing the intermeshed scroll blades. The metal bellows surrounds the crankshaft and is connected to the crankshaft on one end and to a stationary wall at the other end. Since a metal bellows has a high resistance to torsional deformation, it can be used to prevent rotation of the orbiting scroll element. However, abnormal torsional loads, which occur during startup and when the pump ingests debris, may overstress and possibly cause failure of the metal bellows.

A scroll pump which utilizes a metal bellows for isolation and which uses crank mechanisms for synchronization is disclosed in U.S. Pat. No. 3,802,809, issued Apr. 9, 1974 to Vulliez. The metal bellows has a fixed connection at both ends and thus may be overstressed in the event of abnormal torsional loads as described above. The disclosed design is torsionally overconstrained, and the crank mechanisms may impose torsional loads on the metal bellows. In addition, the crank mechanisms are located outside the periphery of the scroll blades and add substantially to the size of the pump.

U.S. Pat. No. 4,371,323, issued Feb. 1, 1983 to Fischer et al., discloses a scroll device having at least one parallel motion guide device including an arrangement of leaf springs to ensure torsionally rigid relative movement of two displacement elements. This synchronization method has no axial load carrying capability.

U.S. Pat. No. 4,534,718, issued Aug. 13, 1985 to Blain, discloses scroll apparatus having first and second scrolls which are interconnected by a flexible, circular band located peripherally of the scrolls for synchronization purposes. The circular band can also be used to support the axial load generated by the scrolls. Applicants have found that the circular band disclosed by the Blain patent does not provide satisfactory performance in some applications. For example, the circular band does not rigidly support the axial loads associated with operation of the scroll apparatus. The lateral bending stresses in the circular band are also high, which can limit the life of the synchronization device.

Accordingly, there is a need for improved scroll-type pumping apparatus.

SUMMARY OF THE INVENTION

According to a first aspect of the invention, scroll pumping apparatus is provided. The scroll pumping apparatus comprises: a first scroll element and a second scroll element; a drive mechanism operatively coupled to said second scroll element for producing orbiting motion of said second scroll element relative to said first scroll element; and a synchronization device, comprising a strip having connected, substantially flat sections coupled between said first scroll element and said second scroll element.

The synchronization device provides synchronization between the first scroll element and the second scroll element during the orbiting motion and supports the axial loads produced during pump operation. Since the synchronization device supports axial loads, pump bearing design is simplified and bearing cost is reduced.

The synchronization device may have a generally square configuration. The substantially flat sections of the synchronization device may be joined by connecting sections. The connecting sections may have a radius or may be substantially flat. In embodiments where the connecting sections have a radius, a ratio of the radius of the connecting sections to the side dimension of the square configuration may be about 0.25 or less. In other embodiments, the synchronization device may have a generally square configuration with right angle corners.

The strip of the synchronization device may include a single layer or two or more layers. The two or more layers may be laminated to form a multiple-ply structure or may be spaced apart.

The synchronization device may comprise a generally square configuration having first and second substantially flat sections on opposite sides of the square configuration. The first and second substantially flat sections may be coupled to the second scroll element. The synchronization device may further comprise third and fourth substantially flat sections on opposite sides of the square configuration. The third and fourth substantially flat sections may be coupled to the first scroll element.

According to a second aspect of the invention, scroll pumping apparatus is provided. The scroll pumping apparatus comprises a scroll set having an inlet and an outlet, the scroll set comprising a stationary scroll element including a stationary scroll blade and an orbiting scroll element including an orbiting scroll blade. The stationary and orbiting scroll blades are intermeshed together to define one or more interblade pockets. The scroll pumping apparatus further comprises a drive mechanism operatively coupled to the orbiting scroll element for producing orbiting motion of the orbiting scroll blade relative to the stationary scroll blade so as to cause the one or more interblade pockets to move toward the outlet, and a synchronization device, comprising a strip having connected, substantially flat sections, coupled between the orbiting scroll element and a stationary component of the scroll pumping apparatus.

According to a third aspect of the invention, a method is provided for operating scroll pumping apparatus of the type comprising a first scroll element and a second scroll element. The method comprises: producing orbiting motion of the first scroll element relative to the second scroll element; and synchronizing the first scroll element and the second scroll element during the orbiting motion with a synchronization device, comprising a strip having connected, substantially flat sections, coupled between said first scroll element and said second scroll element.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
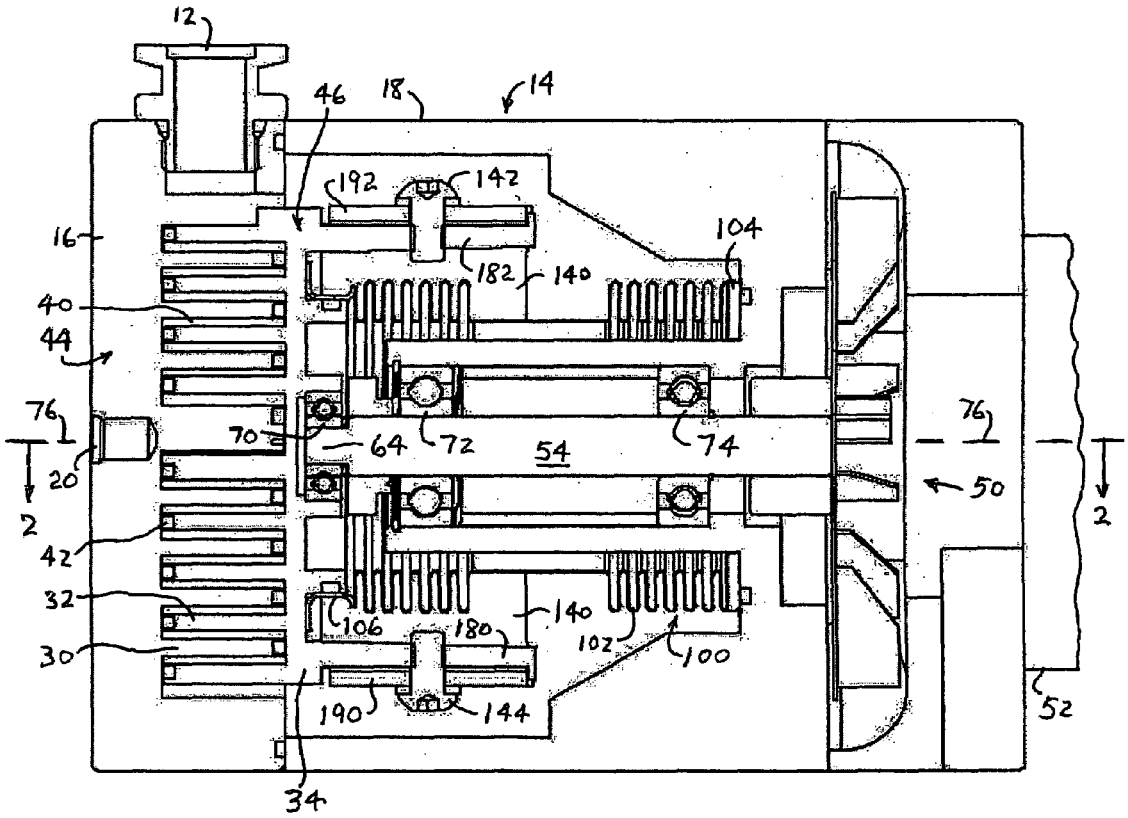
FIG. 1 is a schematic, cross-sectional side view of a scroll pump in accordance with a first embodiment of the invention.
Figure 2:
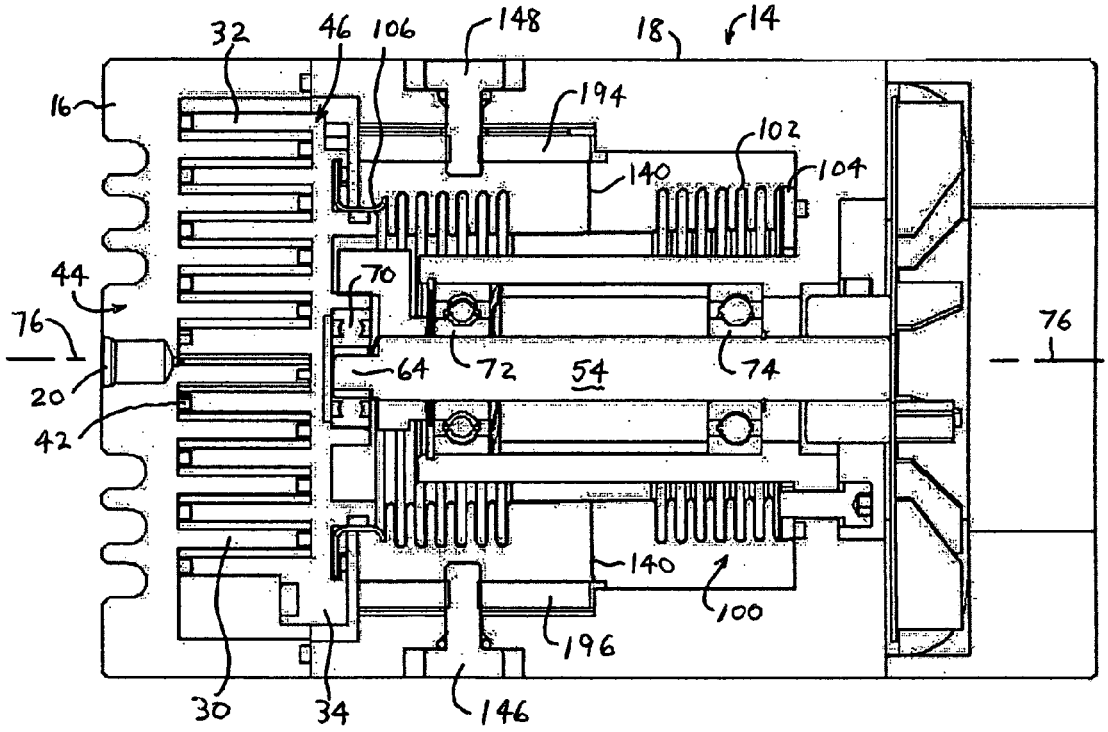
FIG. 2 is a schematic, cross-sectional top view of the scroll pump of FIG. 1.

A scroll pump in accordance with a first embodiment of the invention is shown in FIGS. 1 and 2. A gas, typically air, is evacuated from a vacuum chamber or other equipment (not shown) connected to an inlet 12 of the pump. A pump housing 14 includes a stationary scroll plate 16 and a frame 18. The pump further includes an outlet 20 for exhaust of the gas being pumped.

The scroll pump includes a set of intermeshed, spiral-shaped scroll blades. A scroll set includes a stationary scroll blade 30 extending from stationary scroll plate 16 and an orbiting scroll blade 32 extending from an orbiting scroll plate 34. Scroll blades 30 and 32 are preferably formed integrally with scroll plates 16 and 34, respectively, to facilitate thermal transfer and to increase the mechanical rigidity and durability of the pump. Scroll blade 30 and scroll plate 16 constitute a stationary scroll element 44, and scroll blade 32 and scroll plate 34 constitute an orbiting scroll element 46. Scroll blades 30 and 32 extend axially toward each other and are intermeshed together to form interblade pockets 40. Tip seals 42 located in grooves at the tips of the scroll blades provide sealing between the scroll blades. Orbiting motion of scroll blade 32 relative to scroll blade 30 produces a scroll-type pumping action of the gas entering the interblade pockets 40 between the scroll blades.

A drive mechanism 50 for the scroll pump includes a motor 52 coupled through a crankshaft 54 to orbiting scroll plate 34. An end 64 of crankshaft 54 has an eccentric configuration with respect to the main part of crankshaft 54 and is mounted to orbiting scroll plate 34 through an orbiting plate bearing 70. Crankshaft 54 is mounted to pump housing 14 through main bearings 72 and 74. When motor 52 is energized, crankshaft 54 rotates in main bearings 72 and 74 about an axis 76. The eccentric configuration of crankshaft end 64 produces orbiting motion of scroll blade 32 relative to scroll blade 30, thereby pumping gas from inlet 12 to outlet 20.

The scroll pump may include a bellows assembly 100 coupled between a stationary component of the vacuum pump and the orbiting scroll plate 34 so as to isolate a first volume inside bellows assembly 100 and a second volume outside bellows assembly 100. One end of bellows assembly 100 is free to rotate during motion of orbiting scroll blade 32 relative to stationary scroll blade 30. As a result, the bellows assembly 100 does not synchronize the scroll blades and is not subjected to significant torsional stress during operation. In the embodiment of FIGS. 1 and 2, bellows assembly 100 includes a bellows 102, a first flange 104 sealed to a first end of bellows 102 and a second flange 106 sealed to a second end of bellows 102. Flange 104 may be a ring that is rotatably mounted on crankshaft 54. Flange 106 may have a fixed attachment to orbiting scroll plate 34. Alternatively, flange 106 may be rotatably mounted to orbiting scroll plate 34, and flange 104 may have a fixed attachment to pump housing 14.

The scroll pump further includes a synchronization device 140 coupled between orbiting scroll plate 34 and a stationary component of the vacuum pump, such as frame 18. The synchronization device 140 provides, synchronization between orbiting scroll blade 32 and stationary scroll blade 30 during orbiting motion of scroll blade 32 and supports the axial loads produced during pump operation. Since the synchronization device 140 supports axial loads, pump bearing design is simplified and bearing cost is reduced in comparison with prior art scroll pumps. As described below, synchronization device 140 includes a strip or band having connected, substantially flat sections. which may form a generally square configuration (see FIG. 3) as viewed along axis 76 (see FIGS. 1 and 2). Synchronization device 140 is coupled to orbiting scroll element 46 by bolts 142 and 144 and is coupled to frame 18 by bolts 146 and 148.

Figure 3:
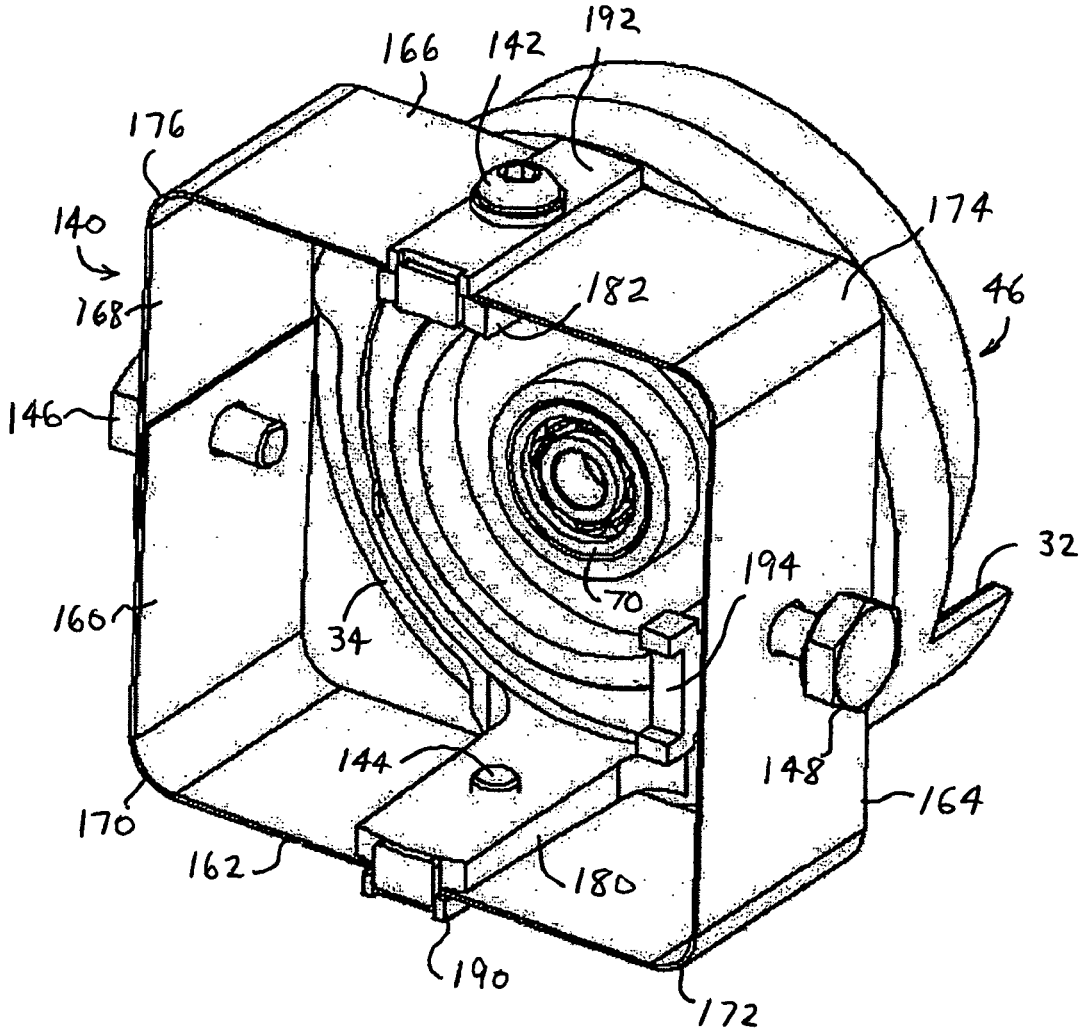
FIG. 3 is a perspective view of the synchronization device and the orbiting scroll element in accordance with the first embodiment of the invention.

Synchronization device 140 is shown in the perspective view of FIG. 3. Synchronization device 140 may include a strip, such as a stainless steel strip, for example, formed into a generally square configuration in the embodiment of FIG.

3. The generally square configuration may have rounded, square or chamfered corners. The strip has a thickness and width selected for lateral flexibility and axial stiffness during operation of the scroll pump. In one example, the strip is fabricated of stainless steel having a thickness of 0.06 cm (centimeter) and a width of 3.8 cm. A side dimension between flat sections is 9 cm and a crankshaft offset (radius of orbiting motion) is 0.157 cm in this embodiment. It will be understood that these dimensions are given by way of example only and are not limiting as to the scope of the invention. Preferably, the cross section of the strip is relatively thin and relatively wide to provide the synchronization device with lateral flexibility and axial stiffness.

The synchronization device 140 should be fabricated of a material having long fatigue life. Ferrous materials are suitable. One suitable material is stainless steel, such as type 321 stainless steel. Other suitable materials include polymers and composites, such as fiberglass.

The strip of synchronization device 140 includes substantially flat sections 160, 162, 164, 166 and 168. In the embodiment of FIG. 3, flat sections 160 and 168 overlap to form one side of the generally square synchronization device. Flat sections 160-168 are interconnected by connecting sections 170, 172, 174 and 176. In the embodiment of FIG. 3, connecting sections 170-176 are rounded and have a radius. In other embodiments, connecting sections 170-176 may be substantially flat. In further embodiments, connecting sections are not used and the flat sections intersect at right angles. In the example described above, synchronization device 140 has a side dimension, defined as the spacing between opposite sides of the synchronization device, of 9 cm, and connecting sections 170-176 have a radius of 0.6 cm.

It will be understood that sections 160-168 of synchronization device 140 are substantially flat when the synchronization device is not deformed. During operation of the scroll pump, however, synchronization device 140 is deformed by orbiting movement of scroll element 46 relative to scroll element 44, thereby causing sections 160-168 of synchronization device 140 to deviate from a flat configuration. Also, synchronization device 140 may be deformed slightly after assembly into the scroll pump.

Flat sections 162 and 166 on opposite sides of synchronization device 140 are affixed to orbiting scroll element 46. As shown in FIGS. 1 and 3, orbiting scroll element 46 is provided with projections 180 and 182. Flat section 162 of synchronization device 140 is affixed to projection 180 of orbiting scroll element 46 by bolt 144 and a clamping element 190. Flat section 166 of synchronization device 140 is affixed to projection 182 of orbiting scroll element 46 by bolt 142 and a clamping element 192. Thus, the flat sections of synchronization device 140 are clamped between the projections of orbiting scroll element 46 and the respective clamping elements.

Flat sections 164 and 160, 168 on opposite sides of synchronization device 140 are affixed to frame 18 of the scroll pump by bolts 148 and 146. Bolt 146 passes through sections 160 and 168, which overlap and form one side of the generally square synchronization device. Flat section 164 of synchronization device 140 is affixed to frame 18 by bolt 148 and a clamping element 194. Overlapping flat sections 160 and 168 of synchronization device 140 are affixed to frame 18 by bolt 146 and a clamping element 196. Thus, orbiting scroll element 46 is coupled to first and second substantially flat sections 162 and 164 on two opposite sides of synchronization device 140, and a stationary component, such as frame 18, is coupled to third and fourth substantially flat sections 164 and 160, 168 on two other opposite sides of synchronization device 140. In this embodiment, flat sections 160, 162, 164, 166 and 168 are provided with clearance holes for respective mounting bolts.

The connection of synchronization device 140 to orbiting scroll element 46 provides an indirect connection to orbiting scroll blade 32. Similarly, the connection of synchronization device 140 to frame 18 provides an indirect connection to stationary scroll blade 30, since frame 18 and stationary scroll element 16 are rigidly connected. Thus, stationary scroll blade 30 and orbiting scroll blade 32 are synchronized by synchronization device 140 during scroll pump operation. The synchronization device 140 may be coupled between any scroll pump element that is rigidly connected to stationary scroll blade 30 and any scroll pump element that is rigidly connected to orbiting scroll blade 32. The connections are spaced apart, typically by 90°, to permit deformation of synchronization device 140.

In operation, drive mechanism 50 produces orbiting motion of orbiting scroll element 46 relative to stationary scroll element 44. The orbiting motion of scroll element 46 is transmitted through projections 180 and 182 to synchronization device 140. Thus, the points of connection between synchronization device 140 and orbiting scroll element 46 describe an orbiting movement, while the points of connection to frame 18 are fixed. The orbiting movement deforms synchronization device 140, but synchronization device 140 prevents rotational movement of orbiting scroll element 46, and thereby performs synchronization.

It may be observed that synchronization device 140 is easily deformed in a plane perpendicular to axis 76. However, synchronization device 140 has high axial stiffness and exhibits a very small deformation along axis 76 as a result of axial loads during operation of the scroll pump.

Figure 4:
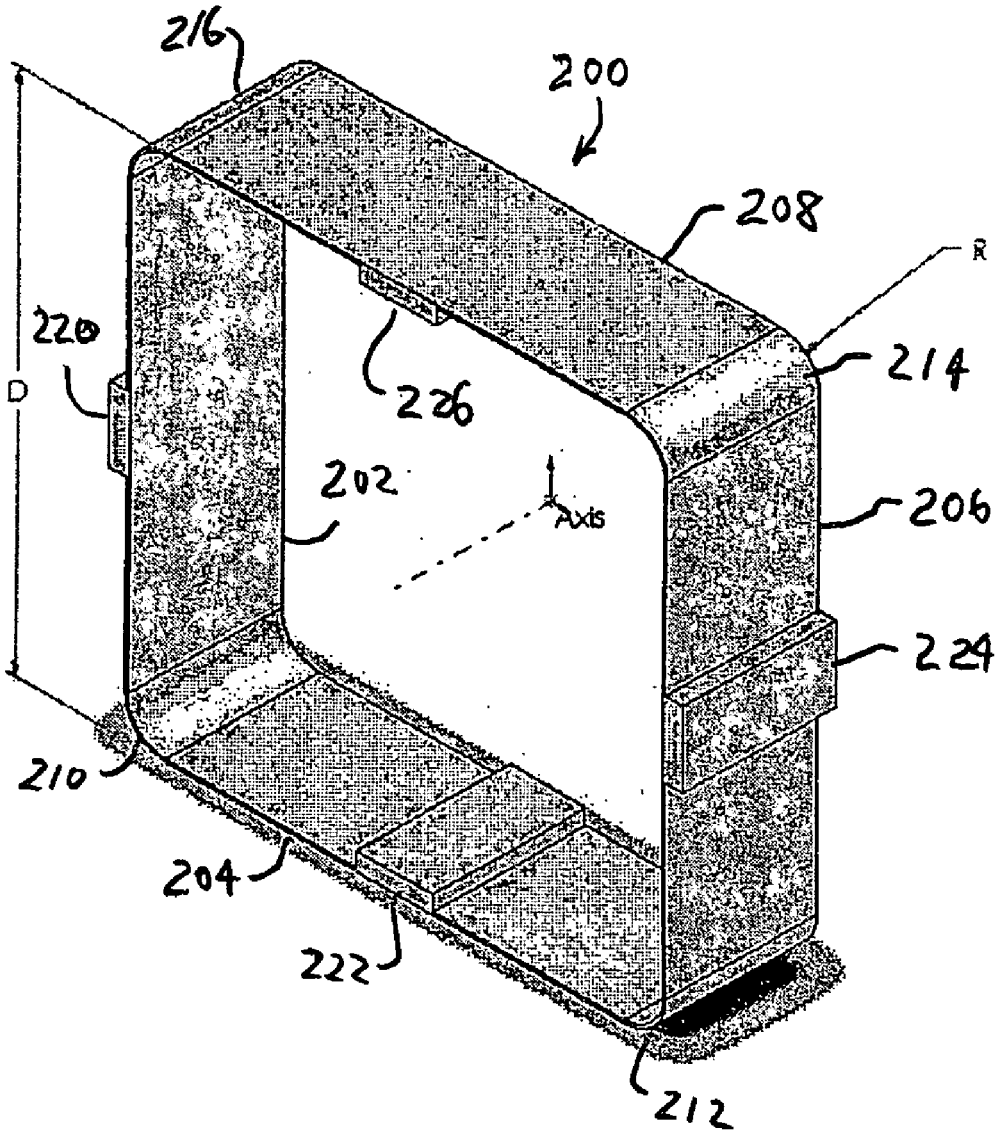
FIG. 4 is a perspective view of a synchronization device in accordance with a second embodiment of the invention.

Synchronization devices in accordance with embodiments of the invention are shown in FIGS. 4, 4A, 4B, 5, 6 and 9. A synchronization device 200 in accordance with a second embodiment of the invention is shown in FIG. 4. Synchronization device 200 includes four substantially flat sections 202, 204, 206 and 208 joined by rounded connecting sections 210, 212, 214 and 216 to form a closed loop having a generally square configuration. The radius of connecting sections 210, 212, 214 and 216 may be about one tenth of the side dimension D of synchronization device 200. Synchronization device 200 may further include reinforcement portions 220, 222, 224 and 226 on respective flat sections. Portions 220, 222, 224 and 226 may provide reinforcement at locations where the synchronization device 200 is coupled to the frame and the orbiting scroll element. The reinforcement portions may be integrally formed with the strip of synchronization device 200 or may be affixed to the strip by an adhesive, rivets or welding, for example.

Figure 4A:
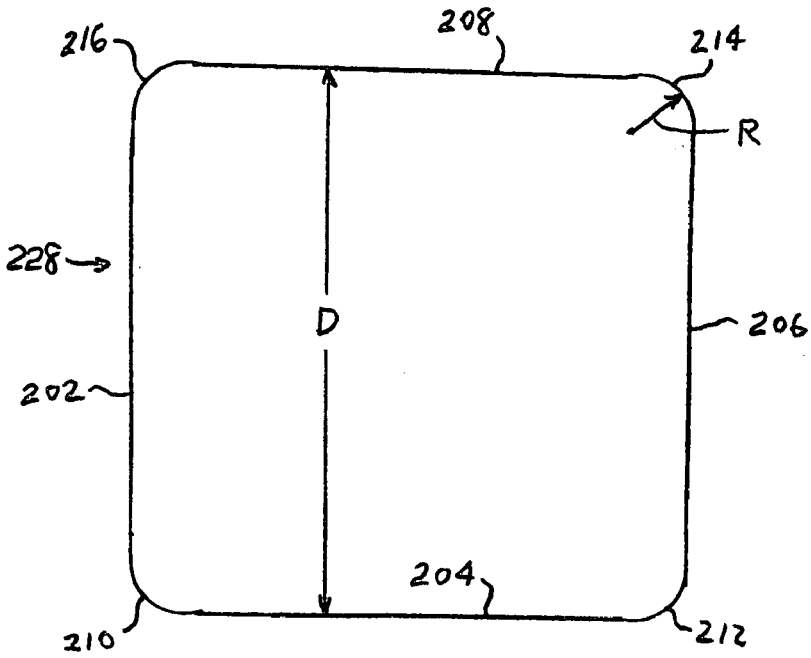
FIG. 4A is a front view of a synchronization device in accordance with a third embodiment of the invention.

A synchronization device 228 in accordance with a third embodiment of the invention is shown in FIG. 4A. Synchronization device 228 is similar to synchronization device 200 shown in FIG. 4, but does not include reinforcement portions. The embodiment of FIG. 4A includes four substantially flat sections 202-208 joined by rounded connecting sections 210-216 to form a closed loop.

Figure 7:
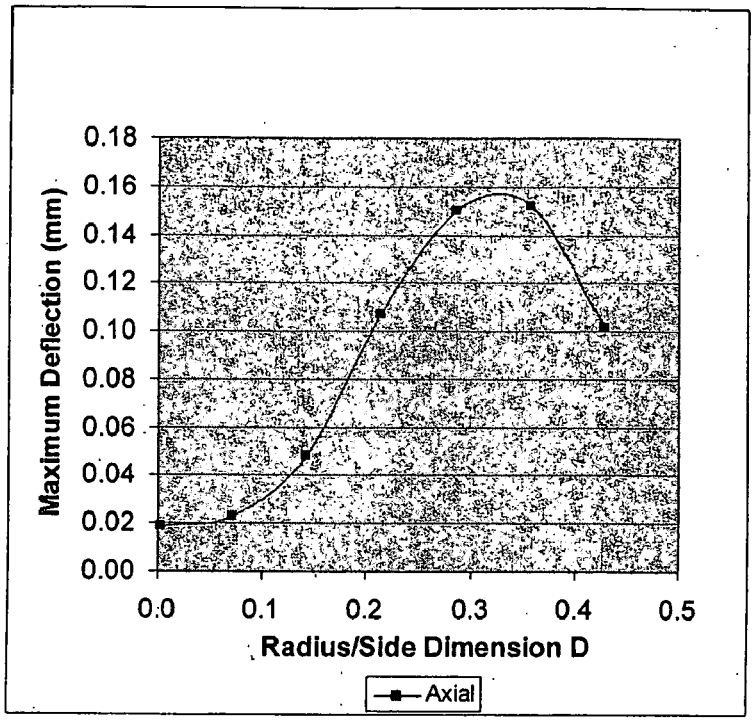
FIG. 7 is a graph of maximum axial deflection of the synchronization device as a function of the ratio of the radius of the connecting sections to the side dimension of the synchronization device.

It has been discovered that the performance of the synchronization device is a function of the ratio of the radius R of connecting sections 210, 212, 214 and 216 to the side dimension D of the synchronization device. In particular, the axial deflection is a function of this ratio. Since a goal of the synchronization device design is to limit axial deflection, a ratio that provides low axial deflection should be selected. Referring to FIG. 7, axial deflection is plotted as a function of the ratio of the radius R to the side dimension D. Axial load (224 Newtons), strip width (3.8 cm) and strip thickness (0.06 cm) are held constant. It may be observed that a ratio of 0.5 corresponds to a circular shape, whereas a ratio of zero corresponds to a square having right angle corners. To achieve low axial deflection, the ratio of the radius R to the side dimension D preferably is about 0.25 or less and more preferably is about 0.1 or less.

Figure 8:
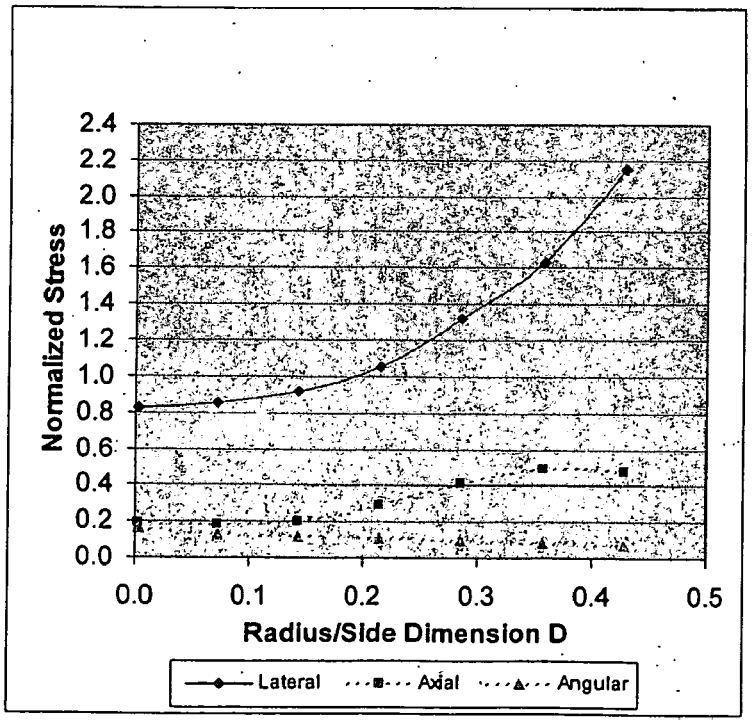
FIG. 8 is a graph of stress/endurance strength of the synchronization device in lateral, axial and angular directions as a function of the ratio of the radius of the connecting sections to the side dimension of the synchronization device.

FIG. 8 illustrates another advantage of the invention over the prior art. Normalized lateral, axial and angular bending stresses are plotted as a function of the ratio of the radius R to the side dimension D (R/D ratio). In FIG. 8, the stresses are normalized to the endurance limit of 321 stainless steel. The axial load (224 Newtons), strip width (3.8 cm), strip thickness (0.06 cm), side dimension D (9 cm) and crank offset (0.157 cm) are all held constant. Lateral and axial bending stresses increase significantly as the R/D ratio increases. The lateral bending stress exceeds the endurance limit of 321 stainless steel for R/D values greater than 0.2. For the prior art, R/D is approximately 0.5 (circular shape). For this geometry, material and applied axial load, the synchronization device would experience a fatigue failure for R/D values greater than 0.2.

FIGS. 7 and 8, taken together, clearly illustrate the advantages of the invention over the prior art. To minimize bending stresses, and to minimize axial deflection, the R/D ratio should be small, preferably about 0.25 or less and more preferably about 0.1 or less.

Figure 4B:
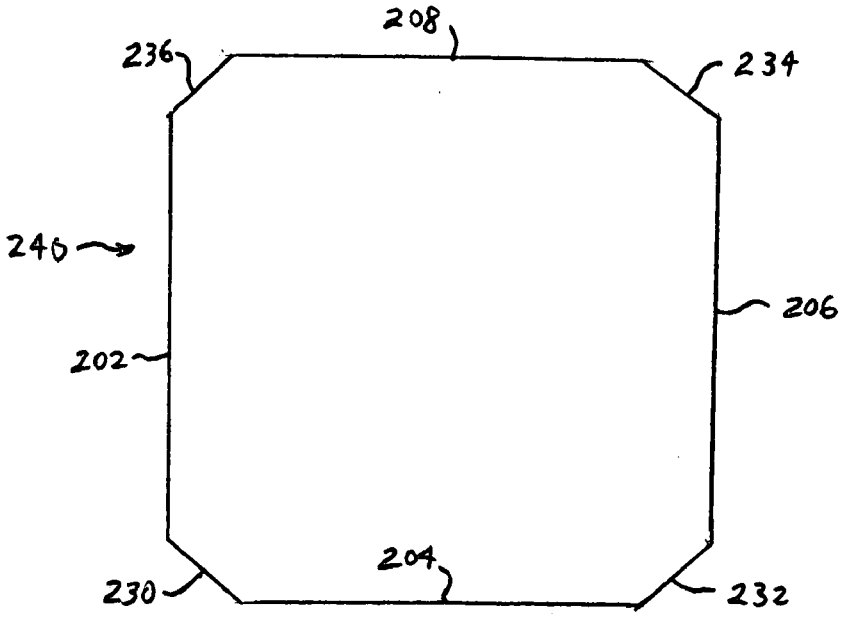
FIG. 4B is a front view of a synchronization device in accordance with a fourth embodiment of the invention.

A synchronization device 240 in accordance with a fourth embodiment of the invention is shown in FIG. 4B. Synchronization device 240 has substantially flat connecting sections 230, 232, 234 and 236 joining the respective flat sections 202, 204, 206 and 208. The synchronization device 240 is thus configured as a square with chamfered corners. Synchronization device 240 may also be viewed as an octagon. The lengths of connecting sections 230, 232, 234 and 236 can be adjusted to control the performance of the synchronization device. As the lengths of the connecting sections approach zero, the synchronization device approaches a square having right angle corners. It will be understood that a square having right angle corners is included within the scope of the invention.

Figure 5:
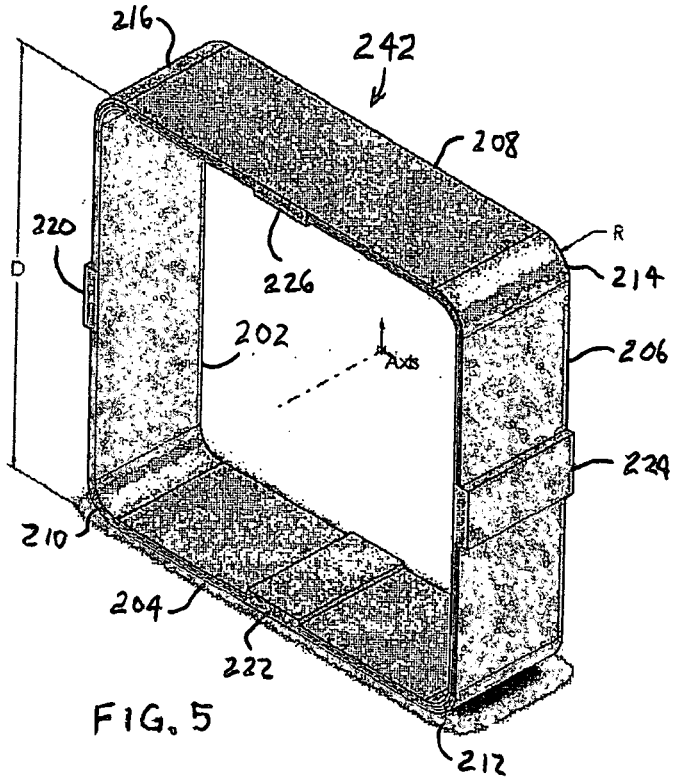
FIG. 5 is a perspective view of a synchronization device in accordance with a fifth embodiment of the invention.

A synchronization device 242 in accordance with a fifth embodiment of the invention is shown in FIG. 5. The synchronization device 242 differs from the embodiment of FIG. 4 in that the strip of the synchronization device 242 has a multiple-ply construction, including two or more layers affixed or laminated together by welding, adhesive, or riveting, for example. The multiple-ply construction exhibits the same bending stress as a single-ply construction, but has greater angular and axial stiffness.

Figure 6:
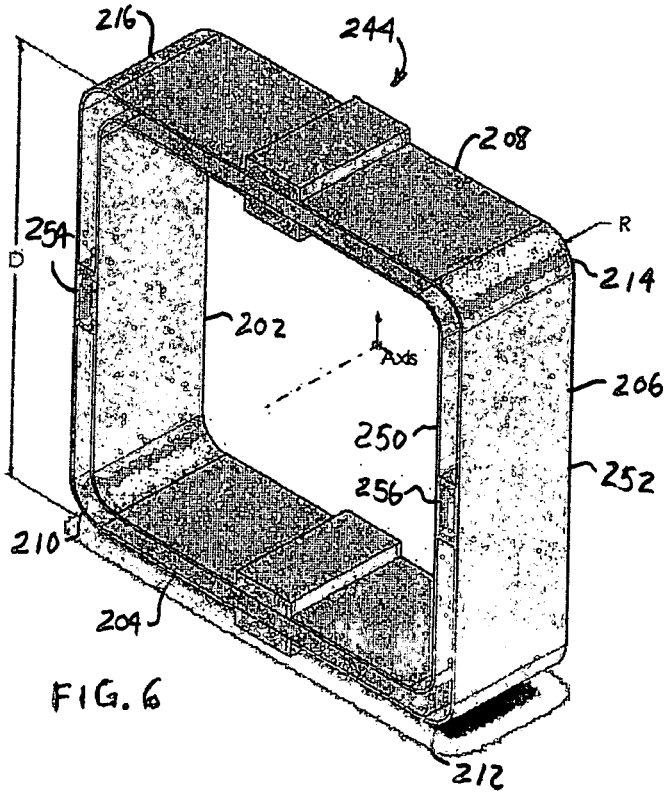
FIG. 6 is a perspective view of a synchronization device in accordance with a sixth embodiment of the invention.

A synchronization device 244 in accordance with a sixth embodiment of the invention is shown in FIG. 6. The strip of synchronization device 244 includes two or more layers that are spaced apart and are connected in discrete areas. Synchronization device 244 includes a closed loop inner layer 250 and a closed loop outer layer 252 of slightly larger dimensions than layer 250. The inner layer 250 and the outer layer 252 are spaced apart and are secured to each other by spacers 254 and 256. It will be understood that the number of layers and the number and size of spacers between layers may be varied within the scope of the invention to provide different performance for different applications.

Figure 9:
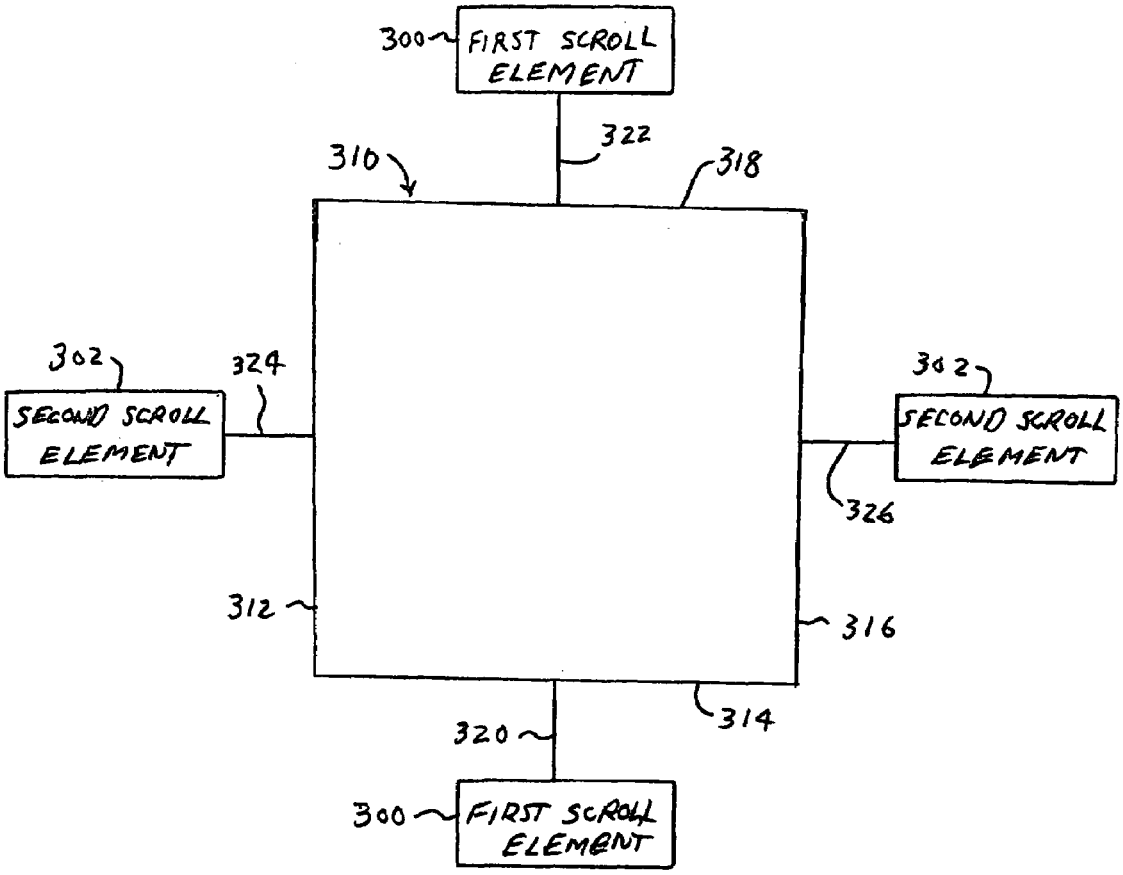
FIG. 9 is a schematic diagram of a scroll pump in accordance with a seventh embodiment of the invention.

A scroll pump in accordance with a seventh embodiment of the invention is shown schematically in FIG. 9. The scroll pump includes a first scroll element 300, a second scroll element 302 and a synchronization device 310. The synchronization device 310 includes a strip having four substantially flat sections 312, 314, 316 and 318 which form a closed loop having a generally square configuration with right angle corners. First scroll element 300 is secured to flat section 314 by a connection 320 and is secured to flat section 318 by a connection 322. Second scroll element 302 is secured to flat section 312 by a connection 324 and is secured to flat section 316 by a connection 326. Connections 320, 322, 324 and 326 may be direct connections or indirect connections. In the case of an indirect connection, synchronization device 310 is secured to a scroll pump component that is rigidly connected to the respective scroll element. Although FIG. 9 illustrates synchronization device 310 as having a square configuration with right angle corners, any synchronization device within the scope of the present invention may be utilized in the scroll pump of FIG. 9.

The first scroll element 300 and the second scroll element 302 can be any scroll elements known in the art or later developed. In general, second scroll element 302 describes orbiting motion relative to first scroll element 300 during operation of the scroll pump. The scroll elements 300 and 302 may correspond to scroll elements 44 and 46, respectively, described above in connection with FIGS. 1 and 2. The scroll elements 300 and 302 may be single-stage scroll elements or may have two or more stages. An example of a single-stage scroll pump is shown in FIGS. 1 and 2. A scroll pump having more than one stage is disclosed in the aforementioned U.S. Pat. No. 5,616,015. Each stage of the scroll pump may include one or more scroll blades. In some embodiments, the scroll elements 300 and 302 may include a stationary scroll element and an orbiting scroll element. In other embodiments, the scroll elements 300 and 302 may have a co-rotating configuration, as disclosed in the aforementioned U.S. Pat. No. 4,534,718, wherein both scroll elements rotate and one scroll element describes orbiting motion relative to the other scroll element. The scroll pump may be oil-lubricated or dry (oil-free) and may operate as a vacuum pump or as a compressor.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. Scroll pumping apparatus comprising:

a first scroll element and a second scroll element;

a drive mechanism operatively coupled to said second scroll element for producing orbiting motion of said second scroll element relative to said first scroll element, the drive mechanism having an axis of rotation; and a synchronization device, comprising a single flexible strip having connected, substantially flat sections coupled between said first scroll element and said second scroll element, wherein the connected, substantially flat sections of the single flexible strip form a generally square, closed-loop configuration as viewed along the axis of rotation of the drive mechanism and wherein the generally square, closed-loop configuration of the single flexible strip provides lateral flexibility in a plane perpendicular to the axis of rotation.

2. Scroll pumping apparatus as defined in claim 1, wherein the substantially flat sections of the synchronization device are joined by connecting sections.

3. Scroll pumping apparatus as defined in claim 2, wherein the connecting sections have a radius.

4. Scroll pumping apparatus as defined in claim 3, wherein a ratio of the radius of the connecting sections to a side dimension of the square configuration is about 0.25 or less, and preferably is about 0.1 or less.

5. Scroll pumping apparatus as defined in claim 2, wherein the connecting sections are substantially flat.

6. Scroll pumping apparatus as defined in claim 1, wherein said strip includes two or more layers.

7. Scroll pumping apparatus as defined in claim 1, wherein the synchronization device comprises a generally square configuration having first and second substantially flat sections on opposite sides of the square configuration, wherein the first and second substantially flat sections are coupled to the second scroll element; and third and fourth substantially flat sections on opposite sides of the square configuration, wherein the third and fourth substantially flat sections are coupled to the first scroll element.

8. Scroll pumping apparatus as defined in claim 1, configured as a vacuum pump or as a compressor.

9. Scroll pumping apparatus as defined in claim 1, wherein the generally square, closed-loop configuration of the single flexible strip provides axial stiffness along the axis of rotation.

10. Scroll pumping apparatus comprising:

a scroll set having an inlet and an outlet, said scroll set comprising a stationary scroll element including a stationary scroll blade and an orbiting scroll element including an orbiting scroll blade, wherein said stationary and orbiting scroll blades are intermeshed together to define one or more interblade pockets;

a drive mechanism operatively coupled to said orbiting scroll element for producing orbiting motion of said orbiting scroll blade relative to said stationary scroll blade so as to cause said one or more interblade pockets to move toward said outlet, the drive mechanism having an axis of rotation; and a synchronization device, comprising a single flexible strip having connected, substantially flat sections, coupled between said orbiting scroll element and a stationary component of said scroll pumping apparatus, wherein the connected, substantially flat sections of the single flexible strip form a generally square, closed-loop configuration as viewed along the axis of rotation of the drive mechanism and wherein the generally square, closed-loop configuration of the single flexible strip provides lateral flexibility in a plane perpendicular to the axis of rotation.

11. Scroll pumping apparatus as defined in claim 10, wherein the substantially flat sections of the synchronization device are joined by connecting sections; and the connecting sections have a radius.

12. Scroll pumping apparatus as defined in claim 10, wherein said strip includes areas for connection to the orbiting scroll element and areas for connection to the stationary component of said scroll pumping apparatus.

13. Scroll pumping apparatus as defined in claim 10, wherein ends of the strip overlap to form one side of a generally square configuration.

14. Scroll pumping apparatus as defined in claim 10, wherein one or more of the substantially flat sections include reinforcing portions.

15. Scroll pumping apparatus as defined in claim 10, wherein the generally square, closed-loop configuration of the single flexible strip provides axial stiffness along the axis of rotation.

16. A method for operating scroll pumping apparatus of the type comprising a first scroll element and a second scroll element, the method comprising:

producing orbiting motion of said second scroll element relative to said first scroll element with respect to an axis of rotation; and synchronizing the first scroll element and the second scroll element during the orbiting motion with a synchronization device, comprising a single flexible strip having connected, substantially flat sections, coupled between said first scroll element and said second scroll element, wherein the connected, substantially flat sections of the single flexible strip form a generally square, closed-loop configuration as viewed along the axis of rotation and wherein the generally square, closed-loop configuration of the single flexible strip provides lateral flexibility in a plane perpendicular to the axis of rotation.

17. The method as defined in claim 16, wherein the synchronization device comprises first and second substantially flat sections on opposite sides of the square configuration, further comprising coupling the first and second substantially flat sections to the second scroll element.

18. The method as defined in claim 17, wherein the synchronization device further comprises third and fourth substantially flat sections on opposite sides of the square configuration, further comprising coupling the third and fourth substantially flat sections to the first scroll element.

19. The method as defined in claim 16, further comprising limiting axial movement of said second scroll element relative to said first scroll element with the synchronization device.

20. The method as defined in claim 16, wherein the generally square, closed-loop configuration of the single flexible strip provides axial stiffness along the axis of rotation.

* * * * *